US008146267B2

(12) United States Patent
Ruiz et al.

(10) Patent No.: US 8,146,267 B2
(45) Date of Patent: Apr. 3, 2012

(54) SHOE INSOLE

(75) Inventors: Abraham Garcia Ruiz, Alicante (ES); Jorge Garcia Ruiz, Alicante (ES)

(73) Assignees: Abraham Garcia Ruiz (ES); Jorge Garcia Ruiz

( * ) Notice: Subject to any disclaimer, the term of this patent is extended or adjusted under 35 U.S.C. 154(b) by 709 days.

(21) Appl. No.: 12/092,573

(22) PCT Filed: Jul. 6, 2007

(86) PCT No.: PCT/ES2007/000406

§ 371 (c)(1),
(2), (4) Date: Sep. 22, 2008

(87) PCT Pub. No.: WO2008/046936

PCT Pub. Date: Apr. 24, 2008

(65) Prior Publication Data

US 2009/0077829 A1 Mar. 26, 2009

(30) Foreign Application Priority Data

Oct. 17, 2006 (ES) ..... 200602249 U

(51) Int. Cl.
*A43B 13/38* (2006.01)

(52) U.S. Cl. ..... 36/3 B; 36/30 R; 36/98; 36/44

(58) Field of Classification Search ..... 36/43, 44, 36/71, 98, 3 B, 3 A, 3 R
See application file for complete search history.

(56) References Cited

U.S. PATENT DOCUMENTS

| | | | | | |
|---|---|---|---|---|---|
| 4,845,862 | A * | 7/1989 | Phillips et al. | ..... | 36/83 |
| 5,778,561 | A * | 7/1998 | Shimoyama | ..... | 36/43 |
| 5,983,524 | A * | 11/1999 | Polegato | ..... | 36/3 R |
| 5,992,052 | A * | 11/1999 | Moretti | ..... | 36/3 B |
| 6,389,711 | B1 * | 5/2002 | Polegato | ..... | 36/3 R |
| 6,408,541 | B1 * | 6/2002 | Moretti | ..... | 36/12 |
| 6,839,984 | B2 * | 1/2005 | Polegato | ..... | 36/3 B |
| 2006/0096123 | A1 * | 5/2006 | Grandini | ..... | 36/3 B |

* cited by examiner

*Primary Examiner* — Jila Mohandesi
(74) *Attorney, Agent, or Firm* — Harness, Dickey & Pierce, P.L.C.

(57) ABSTRACT

The invention relates to an absorbent shoe insole intended to internally line the outsole or sole thereof in order to improve its comfort. The insole is formed from a first profusely perforated water-repellent layer (1) of natural leather or another similar material, a second layer (3) of an absorbent, microporous and hydrophilic material, only allowing the passage of perspiration in a downward direction, a third layer (4) of a purely absorbent material, based on micro-fibers collecting the moisture from the previous layer, a fourth layer (5) based on an open pore heat-formed material acting as a moisture conductor towards the fifth and final layer (6), also of an absorbent material based on micro-fibers and acting as a final moisture collector. An insole with a multi-layer structure is thus achieved, fulfilling the double function of being absorbent and transpirable in addition to forming a flexible, adaptable and shock-absorbing base for the foot of the user.

4 Claims, 2 Drawing Sheets

SHOE INSOLE

CROSS REFERENCE TO PRIOR APPLICATIONS

This application claims the benefit of PCT International Application No. PCT/ES2007/000406, filed Jul. 6, 2007, which claims priority from Spanish Patent Application No. 200602249, filed Oct. 17, 2006, the entire disclosures of which are incorporated by reference herein.

OBJECT OF THE INVENTION

The present invention relates to a shoe insole, specifically to an absorbent insole, intended to internally line the outsole or sole thereof in order to improve its comfort.

The object of the invention is an insole with a multi-layer structure fulfilling the double function of being absorbent and transpirable, in addition to forming a flexible, adaptable and shock-absorbing base for the foot of the user.

BACKGROUND OF THE INVENTION

As is known, most shoes have an insole which is adapted and fixed therein covering the sole and forming the base of support for the sole of the foot, which insole can be planar or heat-formed.

There are single-layer insoles, the sole purpose of which is to internally line the sole in order to improve the aesthetic appearance thereof, although there are multi-layer insoles with which a better adaptation to the foot, better shock-absorbing, etc are attempted to be achieved.

Additionally there are insoles offering a greater or lesser degree of transpirability and others offering an absorbent effect.

However an insole which can offer all the features that were previously mentioned is not known.

DESCRIPTION OF THE INVENTION

The shoe insole proposed by the invention has all the previously mentioned features, i.e. it is transpirable, absorbent, flexible, adaptable and with a shock-absorbing effect.

To that end and more specifically said insole is structured by means of a first profusely perforated water-repellent layer of natural leather or another similar material, with orifices of different sizes, which layer directly receives the perspiration of the foot and due to its special nature and structure drains the perspiration towards the immediately lower layer of the insole.

This second layer of the insole is made of an absorbent fabric, such that the perspiration entering it through the orifices of the first layer and allowing the passage of the perspiration in one direction only, directing said perspiration towards the lower layers of the insole and preventing it from returning to the foot of the user and thus a virtually instantaneous absorption.

This second layer in turn transmits the perspiration to a third layer located below the previous layers, also made of an absorbent material, which layer collects all the moisture from the upper layers.

The existence of a fourth layer based on a heat-formed and open pore material, such as, for example, a layer of spongy material with a considerable thickness and with a thickness that can vary along the length and width of the insole, which in addition to producing a padding thereof acts as a conductor between the third layer and a fifth and final layer of a super-absorbent material acting as a final perspiration collector has been provided as a complement of the described structure and in order to provide the insole with, for example, an anatomic configuration and/or a configuration perfectly adaptable to the inner surface of the sole.

The insole can undergo slight structural modifications according to the specific type of shoe for which it is intended, such that when it is used for low caliber "fine" shoes, such as women's shoes commonly called "dress shoes" for example, the last two mentioned layers are removed from the insole, only the first three layers participating therein, achieving an insole with a very reduced thickness, and such insole satisfactorily fulfilling its function.

DESCRIPTION OF THE DRAWINGS

To complement the description being made and for the purpose of aiding to better understand the features of the invention according to a preferred practical embodiment thereof, a set of drawings is attached as an integral part of said description, in which the following has been represented with an illustrative and non-limiting character.

PREFERRED EMBODIMENT OF THE INVENTION

Figure 1:
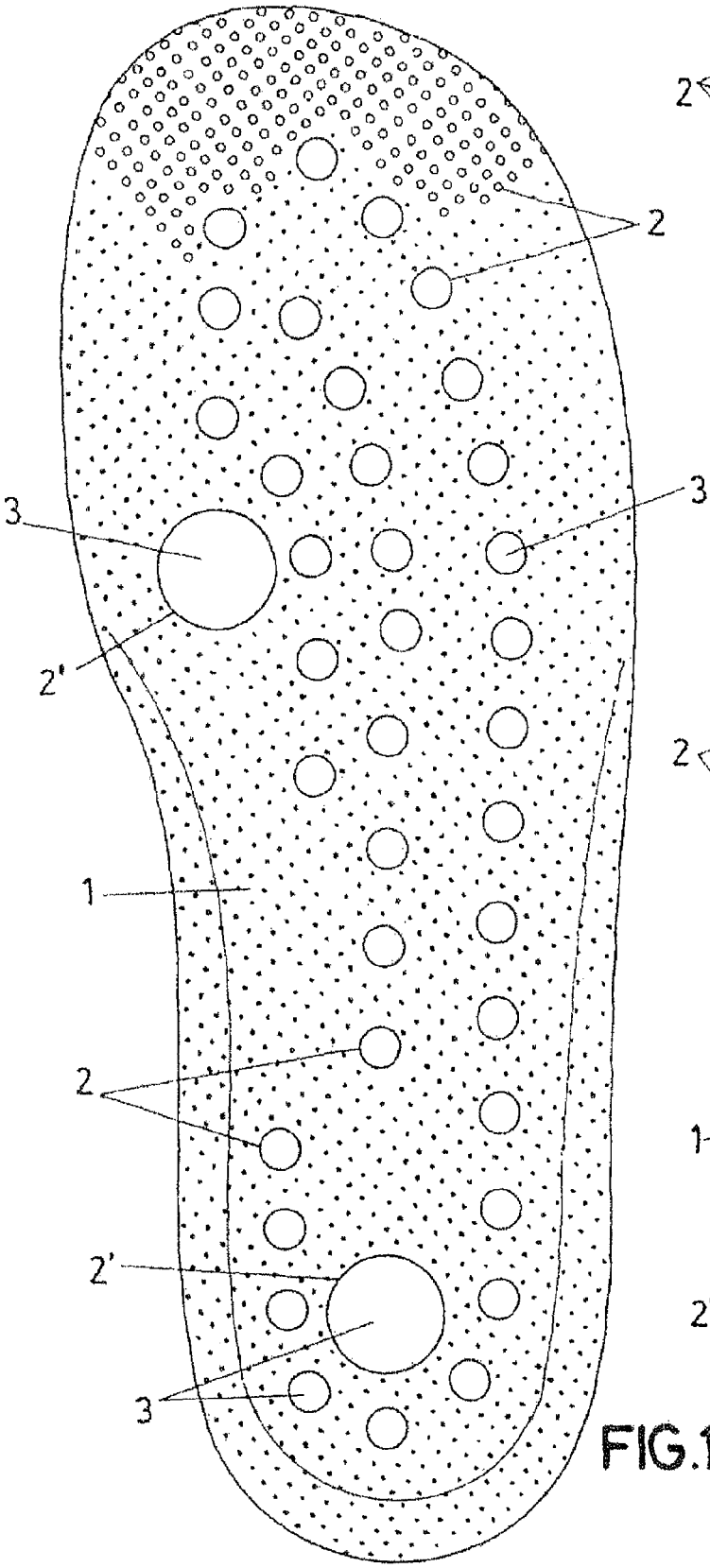
FIG. 1 shows an upper plan view of a shoe insole carried out according to the object of the present invention.
Figure 2:
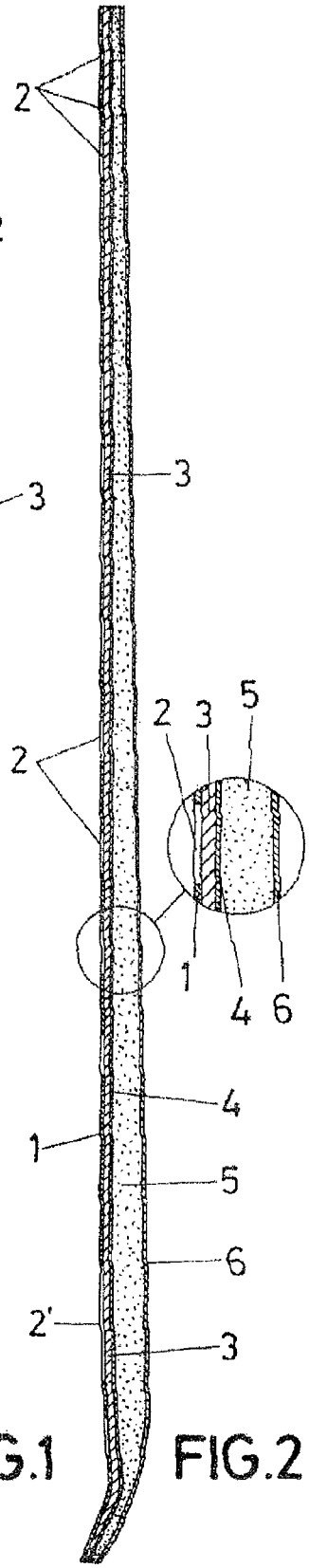
FIG. 2 shows a longitudinal sectional profile of the same insole.
Figure 3:
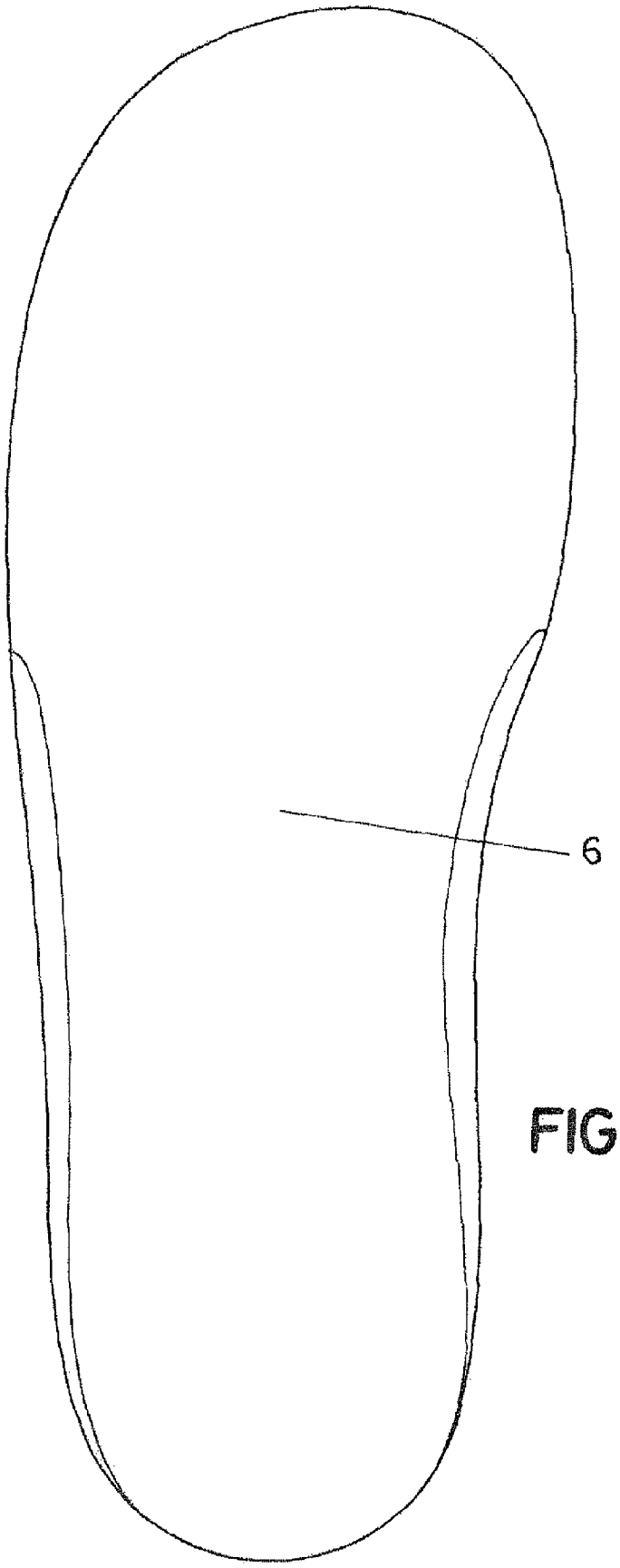
FIG. 3 finally shows a lower plan depiction of the insole.

In view of the indicated figures, it can be observed how the proposed insole is formed from a water-repellent upper layer (1) of natural leather or another similar material having a plurality of orifices (2) conveniently distributed over its entire surface and with different sizes, considerably larger orifices (2') being emphasized, one of which is located in a central position in relation to the heel and the other of which is located in the mid-area of the inner edge of the sole of the foot, since these areas of the foot are those in which the greatest amount of perspiration is concentrated. This size and distribution of the perforations will vary according to the design or model of the insole.

The water-repellent nature of this layer (1) of leather moves the perspiration towards the holes (2-2') distributed over the entire sole, thus initiating the process of eliminating the perspiration from the surface of the insole intended to come into contact with the foot of the user.

Under the mentioned water-repellent layer (1) of natural leather or another similar material, there is formed a layer (3) of an absorbent material, specifically of a microporous and hydrophilic material allowing the passage of perspiration in one direction only, directing said perspiration towards the lower layers of the insole and preventing it from returning to the foot of the user, and thus a virtually instantaneous absorption, as has been previously stated.

A third layer (4) is formed immediately afterwards, which layer is made of a purely absorbent material based on microfibers, intended to collect all the moisture from the immediately upper layer (3).

A considerably thicker fourth layer (5) of an open pore and heat-formed material padding the insole and useful as a moisture conductor between the third layer (3) and a fifth layer (6) completing the insole is then formed.

This final layer (6) is made of an absorbent material, preferably with the same composition as that of the third layer (4), i.e. it is a super-absorbent material having the evident function, like the final layer of the insole, of collecting all the moisture entering it.

Finally, it only remains to point out, as has also been previously stated, that when the insole is intended for shoes with a low caliber sole, said insole can lack the two lower layers, i.e. layers (5) and (6), since due to the nature of this shoe the heat-forming of the insole is not necessary and the necessary absorption level is also substantially lower.

The invention claimed is:

1. A shoe insole of the type adopting a multi-layer structure, characterized in that there is formed therein a first profusely perforated water-repellent layer of natural leather or another similar material, a second layer of an absorbent, microporous and hydrophilic material, allowing the passage of perspiration in a downward direction only, a third layer of an absorbent material, based on micro-fibers collecting the moisture from the previous layer, a fourth layer based on an open pore heat-formed material acting as a moisture conductor towards a fifth and final layer, also of an absorbent material based on micro-fibers and acting as a final moisture collector.

2. A shoe insole according to claim 1, characterized in that the water-repellent layer of leather or another similar material has a great profusion of orifices with a reduced diameter, orifices with an intermediate diameter and other orifices with a large diameter, located in correspondence with the points of greatest perspiration of the sole of the foot.

3. A shoe insole according to claim 1, characterized in that when it is intended for shoes with a lower caliber sole, the bottom incorporates the first three layers, the water-repellent layer of natural leather, the layer of absorbent, microporous and hydrophilic fabric and the layer of absorbent material based on microfibers.

4. A shoe insole according to claim 2, characterized in that when it is intended for shoes with a lower caliber sole, the bottom incorporates the first three layers, the water-repellent layer of natural leather, the layer of absorbent, microporous and hydrophilic fabric and the layer of absorbent material based on microfibers.

* * * * *